United States Patent [19]

Howard

[11] 3,935,410

[45] Jan. 27, 1976

[54] SWITCH ACTUATOR WITH ELONGATED LEVER

[76] Inventor: Albert L. Howard, 27 Pleasant St., Northboro, Mass. 01532

[22] Filed: Sept. 3, 1974

[21] Appl. No.: 502,544

[52] U.S. Cl. ..... 200/332; 200/153 T; 74/519

[51] Int. Cl.[2] ..... H01H 3/04

[58] Field of Search ..... 200/331, 332, 153 T, 61.41, 200/153 H, 330; 74/519, 544

[56] References Cited

UNITED STATES PATENTS

| | | | |
|---|---|---|---|
| 2,468,673 | 4/1949 | Kaminky | 74/519 |
| 2,828,372 | 3/1958 | Bulgin | 200/153 T X |
| 2,939,337 | 6/1960 | Swegar | 74/519 X |
| 3,720,802 | 3/1973 | Fischer | 200/332 |
| 3,832,508 | 8/1974 | Beck | 200/332 |

FOREIGN PATENTS OR APPLICATIONS

| | | | |
|---|---|---|---|
| 1,195,424 | 6/1970 | United Kingdom | 200/153 T |

*Primary Examiner*—James R. Scott
*Assistant Examiner*—William J. Smith
*Attorney, Agent, or Firm*—Norman S. Blodgett; Gerry A. Blodgett

[57] ABSTRACT

Switch actuator having a base adapted to be mounted adjacent a switch and an elongated lever hingedly mounted on the base to make it possible to operate the switch by means other than the fingers.

7 Claims, 4 Drawing Figures

SWITCH ACTUATOR WITH ELONGATED LEVER

BACKGROUND OF THE INVENTION

One of the problems presented by physical disability is that of actuating electrical switches. In almost every case, the operation of an electrical switch is performed by use of the fingers. In many cases, however, physical disability due to shock, arthritis, and the like does not permit the use of the fingers to perform delicate operations of that type. This is particularly true of button-type switches which are operated by placing a finger on a slidable button and pressing it inwardly. Such switches are difficult to actuate even by an able-bodied person, particularly if the room is dark and the switch is located under a cabinet, so that it cannot be directly observed by a normal person standing upright. These and other difficulties experienced with the prior art devices have been obviated in a novel manner by the present invention.

It is, therefore, an outstanding object of the invention to provide a switch actuator which permits the operation of a switch without the use of the fingers.

Another object of this invention is the provision of a switch actuator which allows the operation of a switch by a person suffering a physical disability which prohibits the use of the fingers for that purpose.

A further object of the present invention is the provision of a switch actuator to assist in the operation of a switch which is mounted in a location that is normally dark, or which is hidden from the direct view of the user.

It is another object of the instant invention to provide a switch actuator which can be quickly applied to existing switches without the services of an electrician.

A still further object of the invention is the provision of a switch actuator making use of an elongated lever for its operation, wherein the lever can be readily changed to operate the switch either by pulling or by pushing, and wherein it can be mounted at any level or angle.

It is a further object of the invention to provide a switch actuator which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a switch actuator for use with a switch which has a threaded stem, a plunger, and a nut which is mounted on the stem. The actuator is provided with base which is adapted to lie against the surface from which the switch protrudes. It has a pair of ears extending from the base and a lever is pivotally mounted on a pivot pin which extends between the ears. The lever contacts the switch at a position substantially spaced from the pivot pin.

More specifically, the base is bifurcated to provide two spaced, parallel legs which lie on either side of the switch and are held in place by the nut. Means is provided for holding the lever against the plunger of the switch at all times, so that only a small motion of the lever is necessary to operate the switch.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
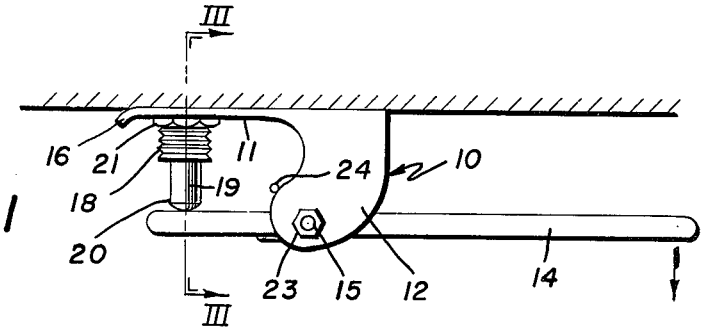
FIG. 1 is a front elevational view of a switch actuator incorporating the principles of the present invention.

Referring first to FIG. 1, wherein are best shown the general features of the invention, the switch actuator, indicated generally by the reference numeral 10, is shown as having a flat base adapted to lie against a surface from which a switch 20 extends. A pair of spaced vertical ears 12 and 13 extend downwardly from the base and a lever 14 is pivotally on a pivot pin 15 which extends between the ears. A lever 14 contacts the switch 20 at a position substantially spaced from the said pivot pin.

Figure 2:
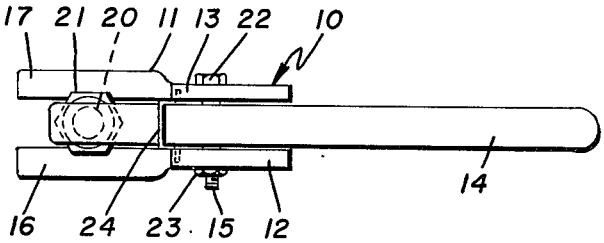
FIG. 2 is a bottom view of the actuator.
Figure 3:
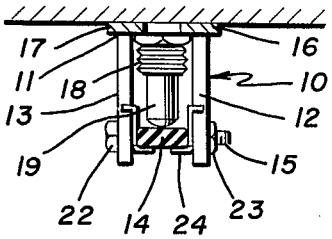
FIG. 3 is a vertical sectional view of the invention taken on the line III-III of FIG. 1.

FIG. 2 shows the manner in which the base 11 is bifurcated to provide two spaced, parallel legs 16 and 17 which lie on either side of the stem of the switch 20. The switch 20 consists of a threaded stem 18 from which protrudes a plunger 19, there being a nut 21 threaded on the stem. This nut operates with the threaded stem to clamp the legs of the base 11 against the surface.

The base 11 and the ears 16 and 17 are integrally formed from sheet metal, while the lever 14 is formed of plastic. The lever is of elongated form and the pivot pin 15 extends through an intermediate portion of the lever. One end of the lever engages the switch plunger 19, while the other end of the lever is adapted to be engaged by the user.

A portion of the lever 14 of the pivot pin 15 to the said other end is heavier, because of its length, than the portion of the lever from the pivot pin to the said one end which contacts the plunger 19. This means that the said one end is maintained at all times in contact with the switch plunger. The action is assisted by a light torsion spring 24 which is wrapped around the pivot pin, the lever, and the ears. The pivot pin 15 consists of a bolt 22 and a nut 23. It is, therefore, readily removable and replaceable to permit reversal of the lever 14 from the first-degree lever operation (shown in FIG. 1) to the second-degree lever operation (shown in FIG. 4). The switch is operated by pulling the lever away from the surface when the lever is in the first-degree condition and the switch is operating by pushing the lever toward the surface when the lever is in the second-degree lever condition.

Figure 4:
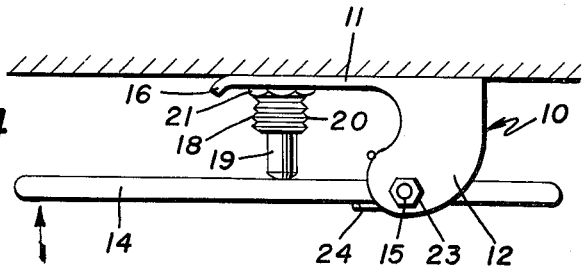
FIG. 4 is a front elevational view of the actuator rearranged in a different operative condition.

The operation of the invention will now be readily understood in view of the above description. The base 11 is attached to the switch 20 by placing the bifurcation and the legs 16 and 17 under the nut 21 and tightening the nut. The handle 14 lies with its short end (as shown in FIG. 1) against the plunger 19 of the switch. A string may be attached to the other end for its operation or it may be operated simply by pulling downwardly. The weight of the outboard portion of the lever 14 holds its short end against the plunger and in addition the light torsion spring 24 performs the same operation. If it is desirable to operate the switch by pressing on the lever 14, (rather than pulling), it is a simple matter to remove the nut 23 and the bolt 22 and reverse the lever so that it operates as a second-degree lever, as shown in FIG. 4. In that case, pressing upwardly on the end will actuate the switch. In this case, it is particularly important that the torsion spring 24 be at least strong enough to hold the handle 14 close to the plunger 19 at all times.

It can be seen, then, that the present device is a simple attachment that may be used with plunger-type switches to permit their operation by persons having a degree of physical disability. The accessory can be arranged to provide for the operation either pulling downwardly on the lever 14 or pushing upwardly, the mode of operation selected being that which is best suited to the physical disability of the user. The accessory can be removed and applied to any desired switch and has the further capability of assisting even non-disabled persons to operate switches that are relatively inaccessible, either because of darkness or because of the location being out of the sight of the user. This latter situation exists, for instance, quite often when a strip light is mounted on the underside of kitchen cabinets.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by letters Patent is:

1. Switch actuator, comprising:

a. base adapted to lie against a surface from which a switch protrudes, the base being bifurcated to provide two spaced, parallel legs which lie on either side of the switch and are clamped in place by a portion of the switch, b. a pair of ears extending from the base, and c. a lever pivotally mounted on a pivot pin extending between the ears, the lever contacting the switch at a position substantially spaced from the pivot pin.

2. Switch actuator as recited in claim 1, wherein the switch comprises a threaded stem which is embraced by the said legs, a plunger which is contacted by the lever, and a nut which is threadedly mounted on the stem and serves to clamp the base against the said surface.

3. Switch actuator as recited in claim 2, wherein the base and ears are integrally formed from sheet metal, and wherein the lever is formed of plastic.

4. Switch actuator as recited in claim 3, wherein the lever is elongated, wherein the pivot pin extends through an intermediate portion of the lever, and wherein one end of the lever engages the switch plunger and the other end of the lever is adapted to be engaged by an operator.

5. Switch actuator as recited in claim 3, wherein the portion of the lever from the pivot pin to the said other end is heavier than the portion of the lever from the pivot pin to the said one end, that the said one end is maintained in contact with the switch plunger.

6. Switch actuator as recited in claim 1, wherein the said pivot pin is readily removable and replaceable to permit reversal of the lever from first-degree lever operation to second-degree lever operation.

7. Switch actuator as recited in claim 6, wherein the switch is operated by pulling the lever away from the surface when the lever is in first-degree lever condition, and wherein the switch is operated by pushing the lever toward the surface when the lever is in the second-degree lever condition.

* * * * *